US005931074A

United States Patent [19]

Matsuoka

[11] Patent Number: 5,931,074

[45] Date of Patent: Aug. 3, 1999

[54] PRESS DEVICE

[75] Inventor: Mitsuo Matsuoka, Hirakata, Japan

[73] Assignee: Umix Co., Ltd., Osaka, Japan

[21] Appl. No.: 08/991,488

[22] Filed: Dec. 16, 1997

[51] Int. Cl.[6] ..... B26D 5/16

[52] U.S. Cl. ..... 83/588; 83/620; 83/627; 83/635; 72/452

[58] Field of Search ..... 83/588, 620, 627, 83/635; 72/452; 100/291

[56] References Cited

U.S. PATENT DOCUMENTS

| | | | |
|---|---|---|---|
| 2,421,864 | 6/1947 | Becker | 83/627 |
| 2,539,085 | 1/1951 | Kerseg | 83/627 |
| 3,033,066 | 5/1962 | Coulon | 83/635 |
| 3,541,909 | 11/1970 | Franzen | 83/635 |
| 3,709,082 | 1/1973 | Leska | 83/627 |
| 4,669,345 | 6/1987 | Suinat et al. | 83/627 |
| 5,101,705 | 4/1992 | Matsuoka | 83/620 |

*Primary Examiner*—M. Rachuba

[57] ABSTRACT

A press device which can be produced at a lower price includes a slide cam base, a slide cam guided by the slide cam base for mounting a machining member such as a punch, a biasing member provided between the slide cam base and the slide cam for biasing the slide cam, and an actuating cam for abutting the slide cam to drive the slide cam. When the slide cam base holds the slide cam, a pressing at a high accuracy with little deflection can be performed and the time required for machining the holding portions of the slide cam is short. The slide cam is slidably provided on a circular-section guide post installed on the slide cam base.

20 Claims, 14 Drawing Sheets

PRESS DEVICE

BACKGROUND OF THE INVENTION

1. Field of the Invention

The present invention relates to a press device. More particularly, the present invention relates to an arrangement for slidably mounting a slide cam to a slide cam base which allows little unwanted deflection, and which provides sufficient biasing force to the slide cam over the entire stroke length of the slide cam.

2. Description of the Background Art

As shown in FIGS. 13 and 14, a prior art press device includes a slide cam base, a slide cam guided by the slide cam base, a machining member such as a punch mounted to the slide cam, a biasing member provided between the slide cam base and the slide cam for biasing the slide cam, and an actuating cam for abutting with the slide cam to drive the slide cam.

In FIGS. 13 and 14, the press device more specifically includes a slide cam base 102 having a quadrangular-section guide member 101 formed at the head thereof, a slide cam 103 guided by the slide cam base 102, a machining member such as a punch 109 mounted to the slide cam 103, a coil spring 104 provided between the slide cam base 102 and the slide cam 103 for biasing the slide cam 103, and an actuating cam 105 for abutting the slide cam 103 to drive the slide cam 103. The quadrangular-section guide member 101 of the slide cam base 102 abuts against a wear plate 106 of the slide cam and is held by guide plates 107, and the guide plates 107 are threadably tightened to the slide cam 103 with many bolts 108.

After a work W has been placed on a supporting member 111 of a lower die 114 in which a die bush 110 was embedded, when an upper die 115 lowers, the wedge-shaped slide cam 103 is moved toward the work W between the slide cam base 102 and the actuating cam 105. Then, when the upper die 115 begins to rise after a machining operation has been completed, the slide cam 103 is moved backward due to a biasing force of the coil spring 104 to its original position.

A stripper plate 112 is biased by a pressurizing rubber 113.

In such press devices as described above, a large problem is not present where the dimension thereof in the lateral direction as shown in FIG. 14 (in the horizontal direction in the figure) is short. However, where the length of the slide cam 103 in the lateral direction becomes a value, for example, about 300 mm or more, the guide member 101 of the slide cam base 102 is held insufficiently with the wear plate 106 and the guide plate 107 mounted to the slide cam 103, so that a noticeable deflection occurs so that pressing with a high precision is hard to perform. Further, machining of the guide member 101, the wear plate 106 and the guide plate 107 requires a longer time, thereby making press devices expensive.

Also, in maintaining the prior art press devices, dismounting the slide cam 103 from the slide cam base 102 requires many bolts 108 to be loosened in order to dismount the guide plate 107, so that maintaining the press devices has taken a longer time.

Further, the output from the coil spring 104 used as a biasing force of the slide cam 103 becomes larger depending on the compressed length and when the compressed length of the coil spring 104 is short, the output becomes small, so that the coil spring 104 may not positively move the slide cam 103 back to the original position. A coil spring with an ordinary size is very difficult to have the compressed length of about 150 mm and thus cannot give a stroke of about 150 mm to the slide cam, so that recently in pressing large-sized works for automobile sheet-metal molded parts such as side panels, such coil spring has not satisfied the needs of a long stroke for the slide cam.

Still further, in prior art press devices, particularly large-sized press devices, the face pressure on the slide face becomes as large as about 150 kg/cm$^2$, so that the wear has been severe; and thus wear prevention is insufficiently provided.

The slide cam has not been properly guided during movement on the slide cam base, so that the slide cam has not always moved precisely.

Further, the slide cam has not been properly guided during moving on the actuating cam, so that the slide cam has not always moved precisely.

SUMMARY OF THE INVENTION

Thus, in view of the above-mentioned circumstances, in order that little deflection occurs when a slide cam base holds a slide cam to allow a precise pressing, and the time required for machining a slide cam holding member becomes short to provide an inexpensive press device, the present invention provides a press device comprising a slide cam base, a slide cam guided by the slide cam base for mounting a machining member such as a punch, a biasing member provided between the slide cam base and the slide cam for biasing the slide cam, and an actuating cam for abutting the slide cam to drive the slide cam, wherein the slide cam is slidably provided on a circular-section guide post installed on the slide cam base.

In order to facilitate dismounting of the slide cam from the slide cam base for maintenance, both ends of the guide post are fitted into a circular hole to hold the guide post, a slit leading to the holes is engraved, and the slit is threadably tightened with bolts to install the guide post.

Further, in the present invention, the biasing member employs a gas spring so that the slide cam can positively slide on the slide cam base.

Still further, a wear plate is provided on respective slid face of both the slide cam and the slide cam base so as to satisfactorily cope with severe wear of large-sized press devices.

Further, in the present invention, a slide face is provided on both the sides of the slide cam so as to make accurate the movement of the slide cam with respect to the slide cam base.

Still further, a chevron-shaped slide face is provided on the slide face so as to eliminate a lateral deflection in the movement of the slide cam with respect to the actuating cam.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

With reference to specific embodiments shown in the attached drawings, the present invention will be explained in detail hereinafter.

Figure 1:
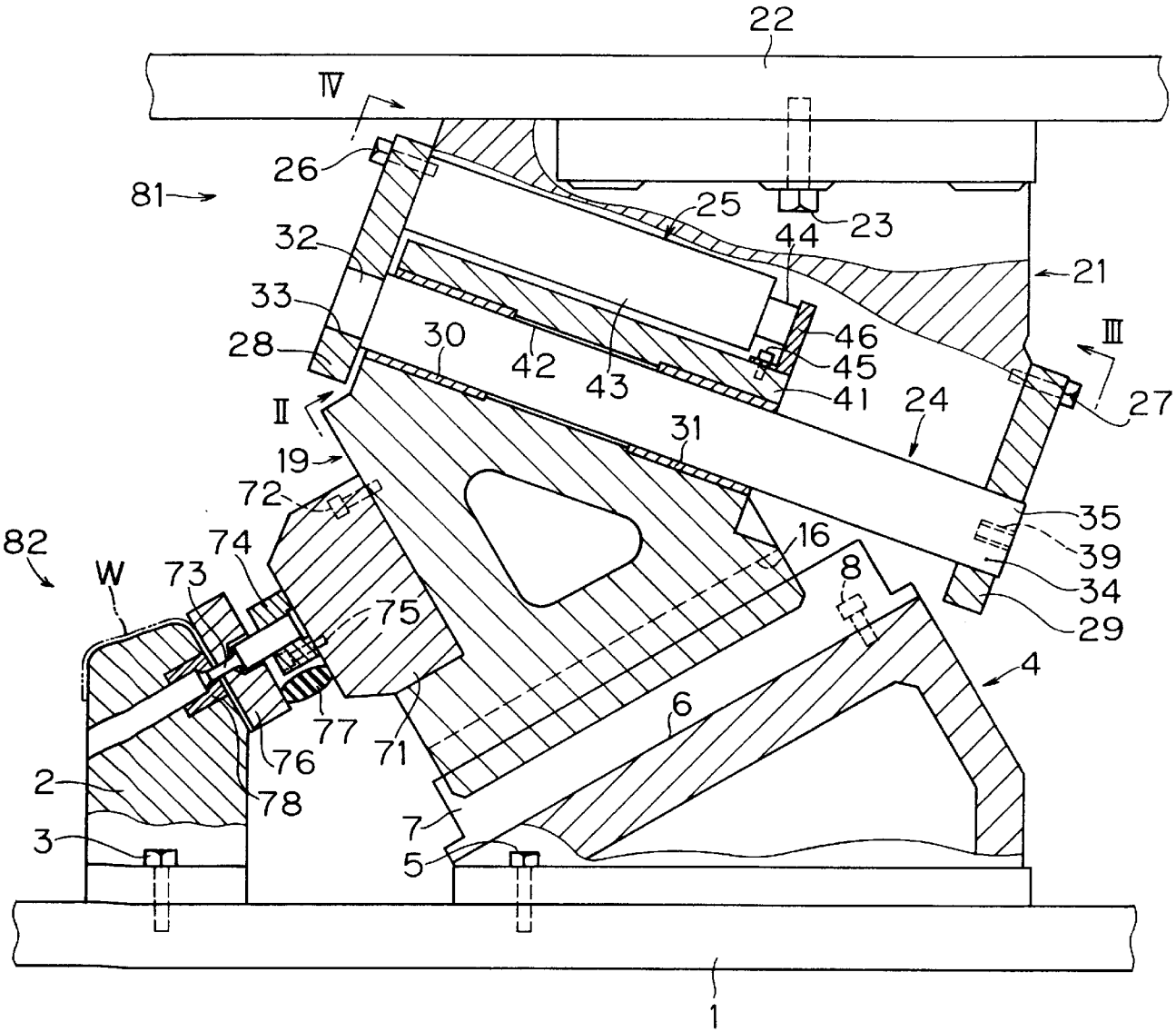
FIG. 1 is a longitudinal sectional view of one specific embodiment of the present invention at the lower dead point thereof.
Figure 2:
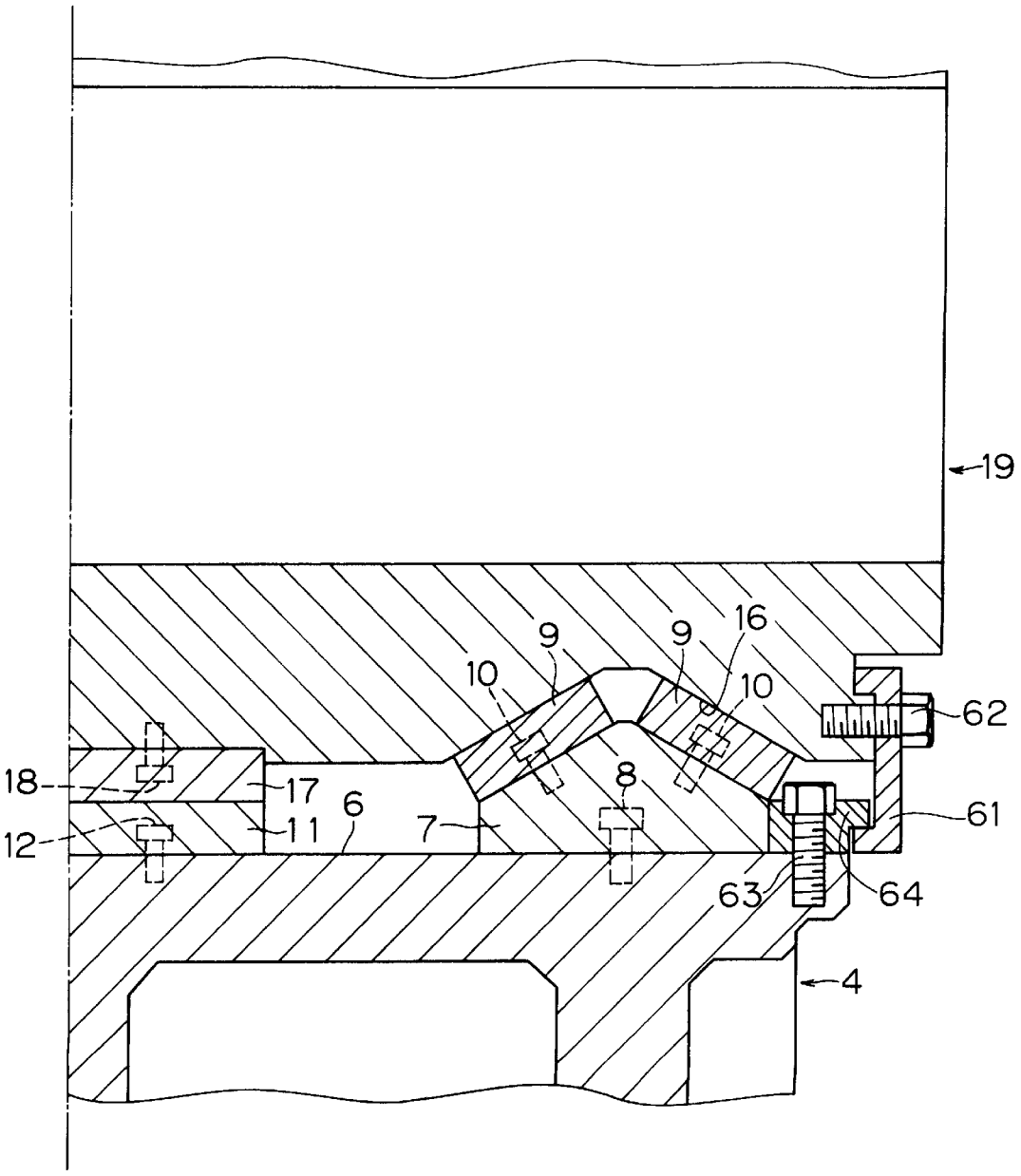
FIG. 2 is a cross-sectional view taken along the line II—II of FIG. 1.
Figure 3:
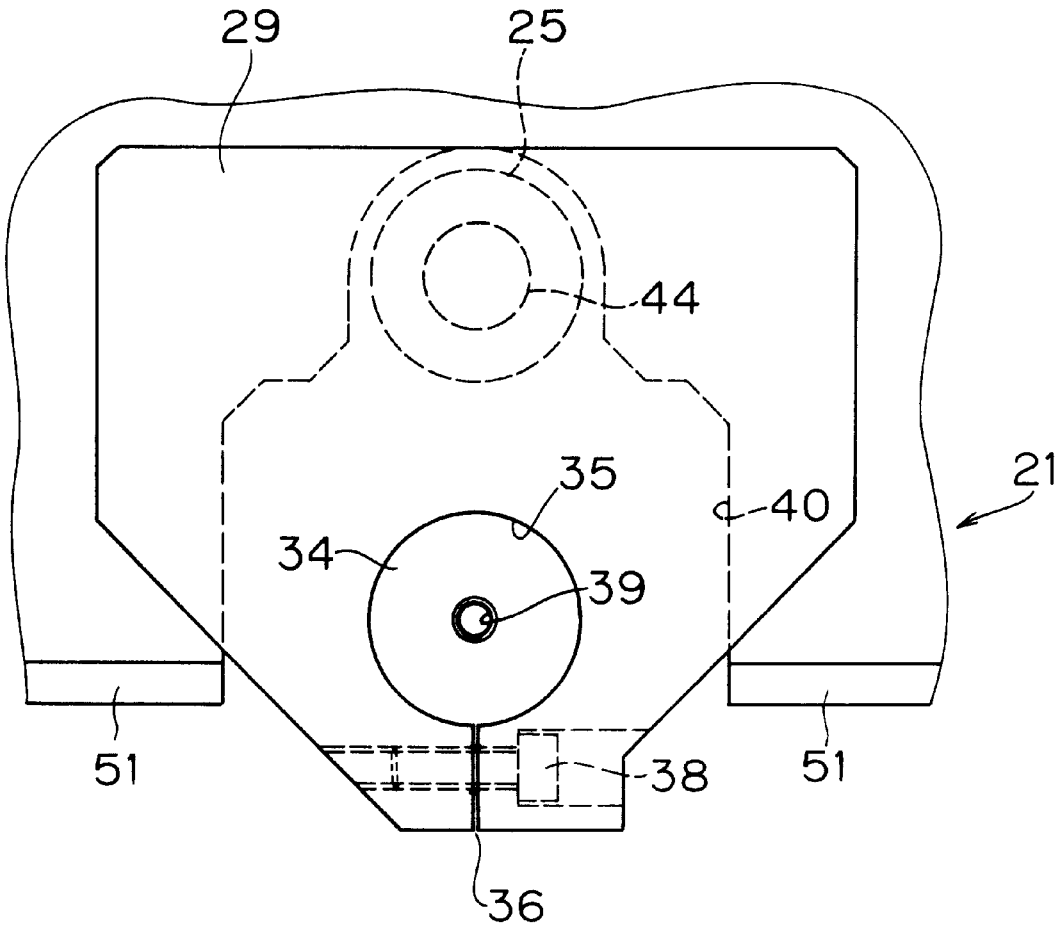
FIG. 3 is a cross-sectional view taken along the line III—III of FIG. 1.
Figure 4:
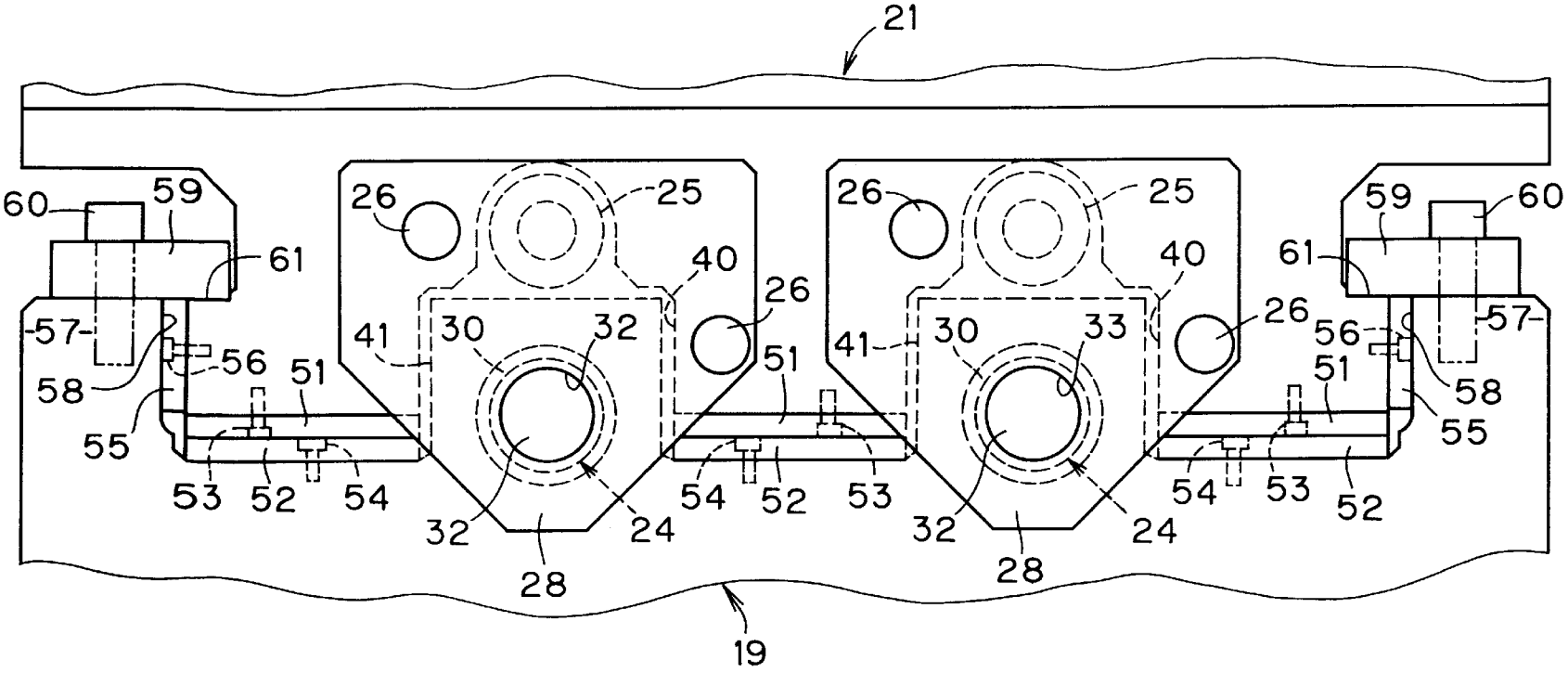
FIG. 4 is a cross-sectional view taken along the line IV—IV of FIG. 1.
Figure 11:
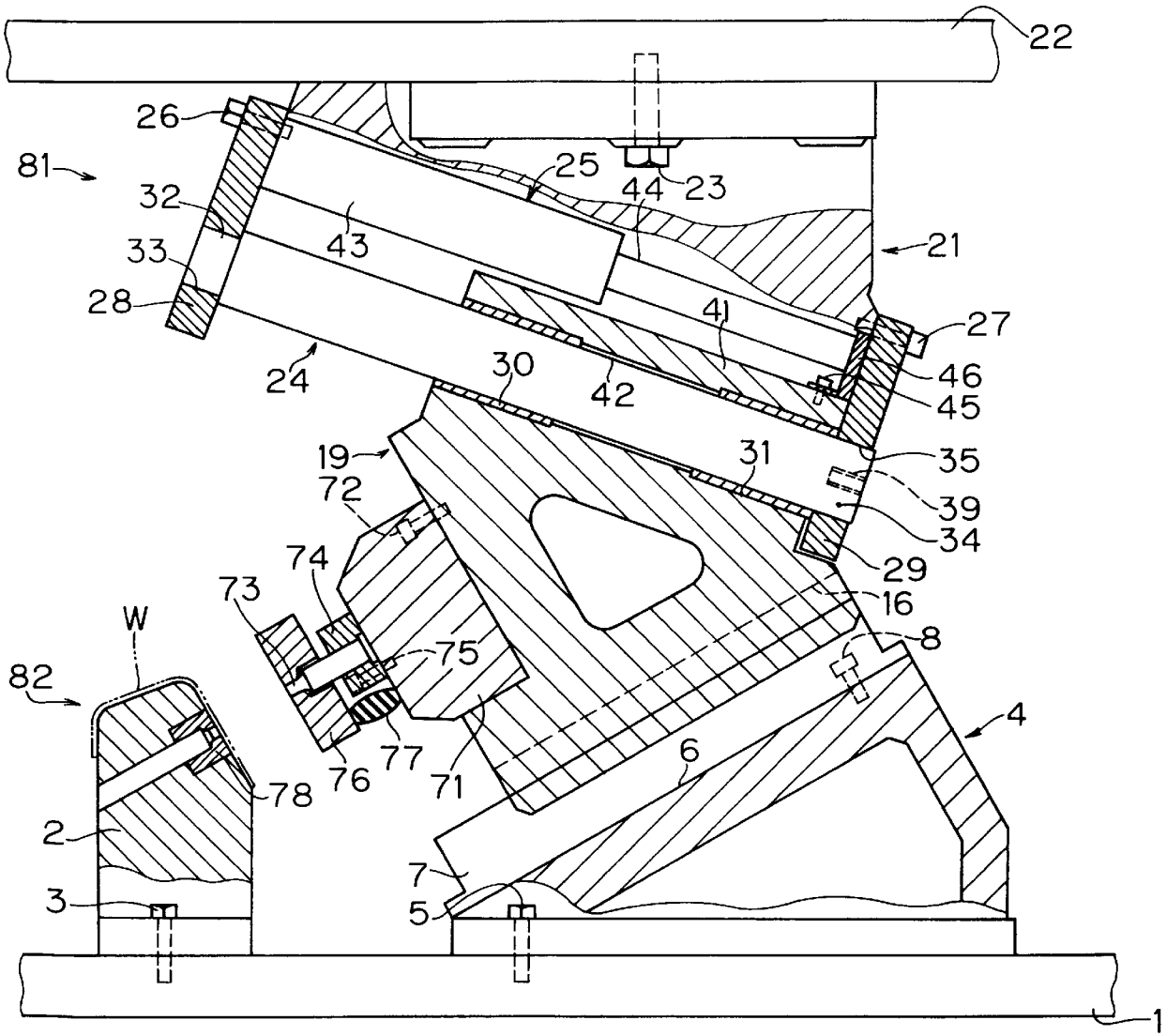
FIG. 11 is a longitudinal sectional view of one specific embodiment of the present invention at the upper dead point thereof.
Figure 12:
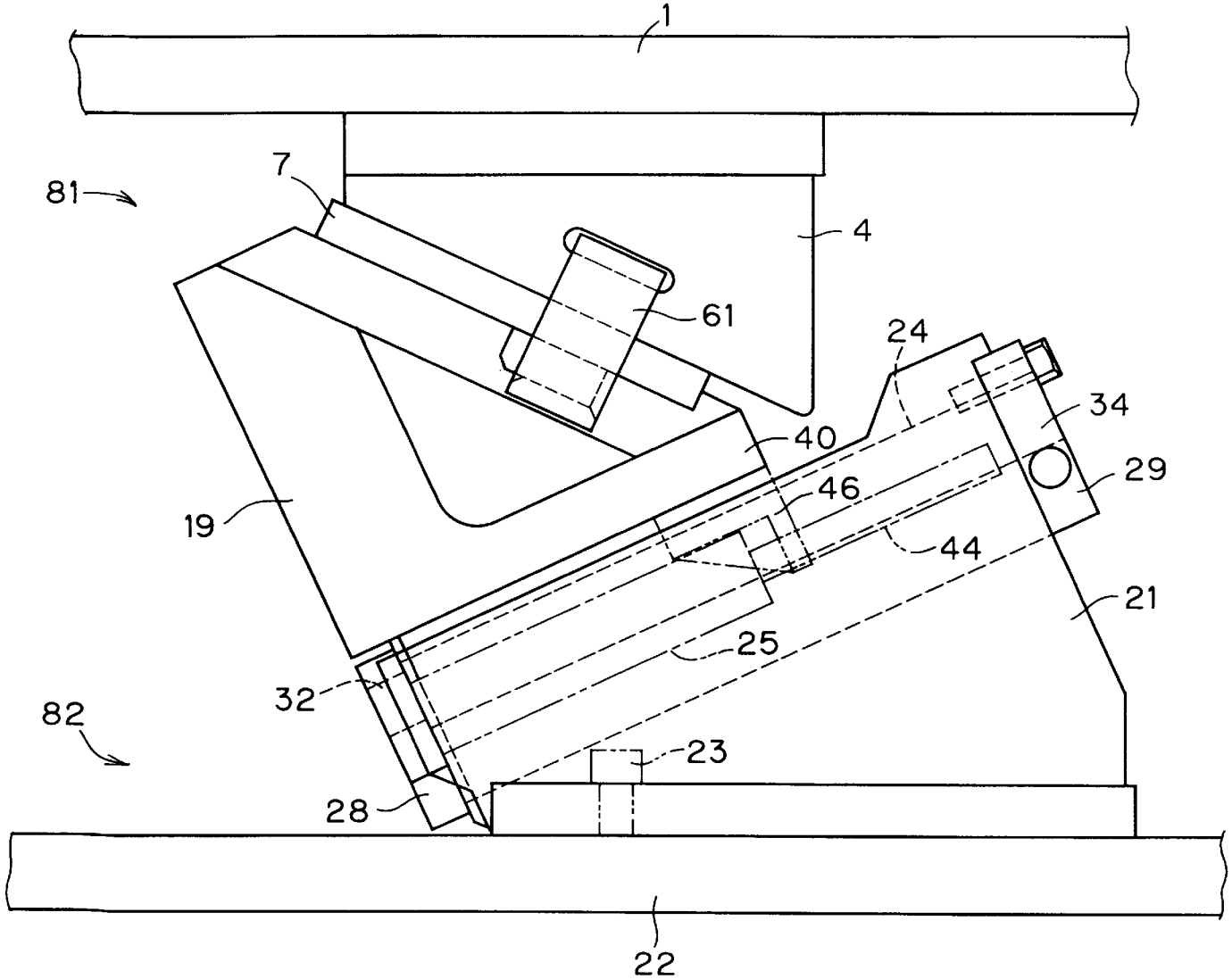
FIG. 12 is a longitudinal sectional view of a press device of an example in which a slide cam base is arranged on a lower die and an actuating cam on an upper die.
Figure 13:
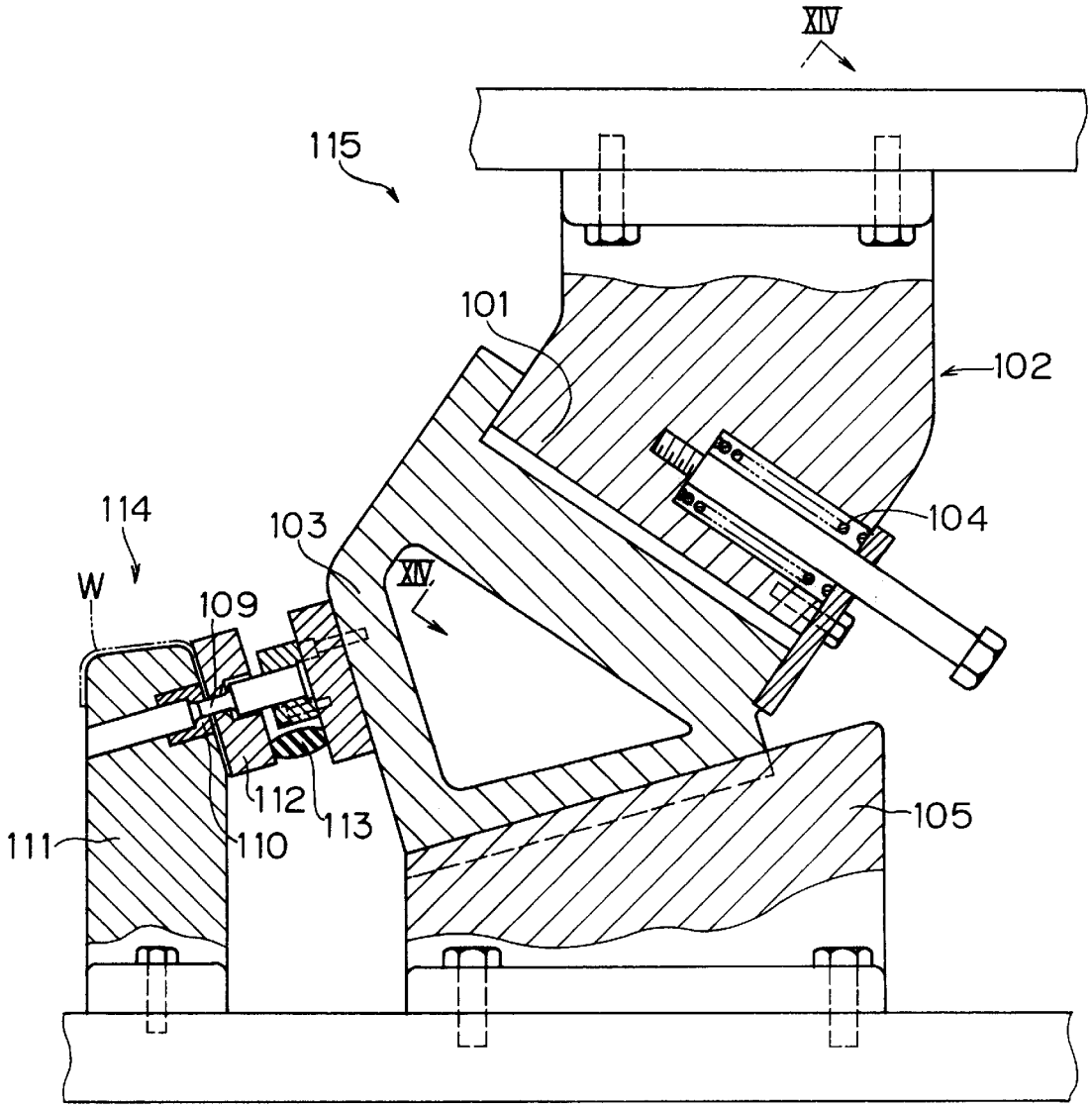
FIG. 13 is a longitudinal sectional view of a prior art press device.
Figure 14:
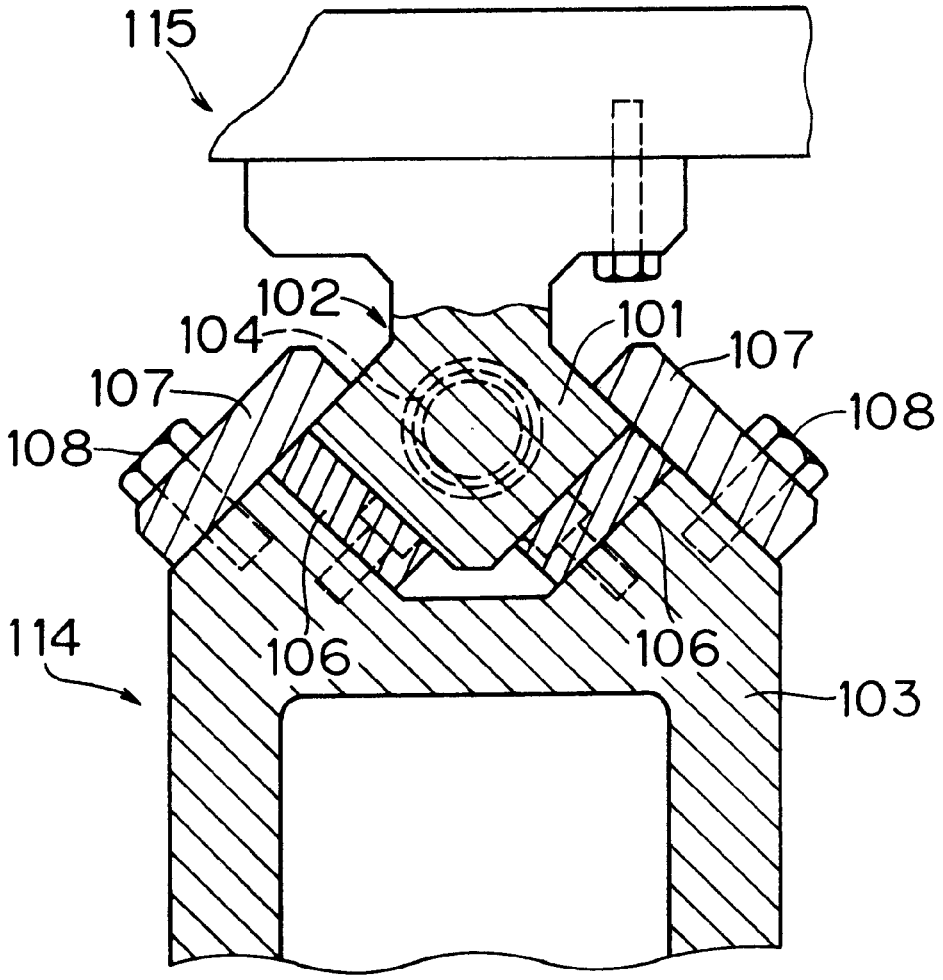
FIG. 14 is a cross-sectional view taken along the line XIV of FIG. 13.

FIG. 1 is a longitudinal sectional view of one specific embodiment of the present invention at the lower dead point thereof. FIG. 2 is a cross-sectional view taken along the line II—II of FIG. 1. FIG. 3 is a cross-sectional view taken along the line III—III of FIG. 1. FIG. 4 is a cross-sectional view taken along the line IV—IV of FIG. 1. FIGS. 5 through 10 are layout views of guide posts, a gas spring and wear plates according to the size of a slide cam. FIG. 11 is a longitudinal sectional view of the embodiment at the upper dead point thereof. FIG. 12 is a longitudinal sectional view of a press device of an example in which a slide cam base is arranged on a lower die and an actuating cam on an upper die.

The example explained in this embodiment is the one in which a work is punched.

As shown in FIG. 1, a supporting member 2 for positioning a work W is fixed to a lower base plate 1 of a lower die 82 with a bolt 3.

An actuating cam 4 whose upper face is inclined downwardly approaching the supporting member 2 and slants upwardly to the right as viewed in the figure is fixed at a place near the supporting member 2 to a lower base plate 1 with a bolt 5. Fixed to an inclined face 6 of the actuating cam 4 is a chevron-shaped guide member 7 with a bolt 8.

As shown in FIG. 2, fixed to the upper face of the chevron-shaped guide member 7 is a wear plate 9 with a bolt 10, and further fixed to the inclined face 6 is also a wear plate 11 with a bolt 12.

As shown in FIG. 2, an approximately wedge-shaped slide cam 19 which is engraved with a V-groove 16 on the lower face thereof, and is mounted with a wear plate 17 with a bolt 18 on another place of the lower face, is allowed to abut both the V-groove 16 against the wear plate 9 of the actuating cam 4 and the wear plate 17 against the wear plate 11 of the actuating cam 4, thereby slidably placing the slide cam 19 on the actuating cam 4.

On the other hand, a slide cam base 21 whose lower face is inclined reversely to the above-mentioned actuating cam 4 and slants downwardly to the right as viewed in the figure is fixed to an upper base plate 22 of an upper die 81 with a bolt 23. The above-mentioned slide cam 19 is slidably provided on a guide post 24 which slants downwardly to the right and is installed at the lower end of the slide cam base 21. The slide cam 19 is biased by a gas spring 25 which is contained in the slide cam base 21 and arranged slantingly to the right.

The guide post 24, as shown in FIG. 1, is installed to supporting plates 28, 29 fixed with bolts 26, 27 respectively to both the respective sides of the slide cam base 21. The guide post 24 is fitted into bushes 30, 31 which are coaxially and fixedly press fitted into an inserting hole 42 of a guide post holder 41 of the upper portion of the slide cam 19. One small-diameter end portion 32 of the guide post 24 is fitted into a fitting hole 33 of the supporting plate 28, while the other end portion 34 is fitted into a tightening hole 35 of the supporting plate 29.

As shown in FIG. 3, a slit 36 leading from the outer peripheral portion to the tightening hole 35 is engraved in the supporting plate 29, and a bolt 38 is inserted into, perpendicularly to, and threadably attached to the slit 36 so that the gap of the slit is reducible, and thus the other end portion 34 of the guide post 24 located in the tightening hole 35 can be tightened.

A circular outer peripheral face or a circular hole shape, can be more precisely machined compared to rectangular or other shapes. Thus, in the present invention, the guide post 24 is made circular in section and the bushes 30, 31, the fitting hole 33 and the tightening hole 34 are made circular in bore, so that they can be precisely machined. Due to the fitting relationship between the circular outer peripheral face of the guide post 24 and the circular hole of the bushes 30, 31, a highly accurate fitting is maintained from the axial center to the whole periphery covering 360 degrees.

The guide post, if circular in section, may be solid or hollow in section, and however, where possible, preferably solid with respect to strength.

For the maintenance of the slide cam 19, the actuating cam 4, the slide cam base 21 and the like, the slide cam 19, may be dismounted from the slide cam base 21. In that case, loosening only one bolt 38 of the supporting plate 29 allows the guide post 24 to be easily pulled out without removing many bolts as in prior art press devices. When a bolt is threadably attached to a screw hole 39 engraved in the other end portion 34 of the guide post 24, the guide post 24 can be more easily pulled out by the bolt.

FIG. 4 shows a configuration in which the slide cam 19 is provided by interposing the guide post 24 and the gas spring 25 in the slide cam base 21.

Provided on the underside of the slide cam base 21 are guide grooves 40 slanting to the right at two places in the indicated example; the slide cam 19 protrusively provides guide post holding portions 41 slanting to the right on the upper face thereof, and the guide post holding portions 41 are movable within the above-mentioned guide grooves 41. An inserting-through hole 42 slanting to the right is bored in the guide post holding portion 40, and the bushes 30, 31 are coaxially press fitted into the inserting-through hole 42, and then the guide post 24 is internally fitted into the bushes 30, 31. The above-mentioned supporting plate 28 is provided in a manner to cover the above-mentioned guide groove 40 and guide post holding portion 41, and is fixed with a bolt 26.

The gas spring 25 is arranged in a manner to slant to the right, and is fixedly mounted at the base end thereof to the supporting plate 28. An expansible rod 44 at the head of a cylinder 43 of the gas spring 25 is allowed to abut against a bracket 46 fixed with a bolt 45 to an end slanting to the right on the upper face of the slide cam 19. The slide cam 19, which is wedge shaped, is caught between the actuating cam 4 and the slide cam base 21, and urged to move toward the work W on the supporting member 2, thereby machining the work W. FIG. 1 shows the press device at the lower dead point. The slide cam 19 is positioned near the supporting member 2 and at the leftmost side in the figure. The rod 44 of the gas spring 25 is in the most contracted state. When there becomes nil a force of binding the slide cam 19 with the actuating cam 4 and the slide cam base 21, an abutting force of the gas spring 25 is exerted on the slide cam 19 to cause the rod 44 to be extended. FIG. 11 shows the press device at the upper dead point in a state in which the the rod 44 is extended to a maximum limit.

The gas spring 25 contains a gas with a high pressure, for example, that of 150 kg/cm$^2$ according to an application within the cylinder 43. The rod 44 is attached to a piston (not shown) movable within the cylinder 43. The piston separates the interior of the cylinder 43 into two chambers. When the rod 44 protruding from the cylinder 43 expands or contracts, a substantially constant output, for example, that of 150 kg/cm$^2$ can be obtained over the entire length of the rod contracting stroke. This is accomplished in such a manner that when the rod 44 contracts to cause one of the two chambers contained in the cylinder 43 to be subjected to a pressure, the high-pressure gas flows out of the one chamber and enters the other chamber, thereby providing a substantially constant output over the full stroke of the rod. The gas spring used in the present invention is made by DADCO INC.

Thus, unlike a coil spring, with the gas spring 25, a high output is obtained over the full stroke from the start of operation, so that the gas spring allows the slide cam 19 to be returned positively to the original position and thus is safe for operation.

Also, the gas spring 25 allows the slide cam 19 to be moved for a long distance of about 150 mm, so that large-sized works for automobile sheet-metal molded parts such as side panels can be machined.

Wear plates 51, 52 are provided on the slide faces of the slide cam base 21 and the slide cam 19, respectively. The wear plate 51 is fixed to the slide cam base 21 with a bolt 53, while the wear plate 52 is fixed to the slide cam 19 with a bolt 54.

Heretofore, in a press device including such a slide cam whose face pressure is about 50 to 60 kg/cm$^2$, a wear plate has been provided on only either the slide cam base or the slide cam, while in the present invention, in order that it can be used even for a large-sized press device whose face pressure is about 150 kg/cm$^2$, the wear plates are provided on the slide cam base and the slide cam, respectively, so that it is sufficient to replace only the wear plate having worn.

Although the slide cam 19 is guided by the guide post 24 installed on the slide cam base 21 as described above, wear plates 55 are fixed with bolts 56 to both the ends of the slide cam base 21, against which wear plate 55 an internal slide face of a side portion 57 of the slide cam 19 is abuted, so that the slide cam 19 can be precisely moved on the slide cam base 21.

Further, for the slide cam 19, guide plates 59 are fixed with bolts 60 to the upper faces of both the side portions 57 thereof, and the underside of the guide plate 59 is allowed to abut against a guide face 61 of the slide cam base 21 so that the guide face 61 can be used as an auxiliary guide for the slide cam 19, and at the same time, even if the guide post 24 should break, the slide cam 19 will be held by the slide cam base 21 to make safety absolutely sure.

Heretofore, in a press device including such a slide cam, even where the dimension of the slide cam in the lateral direction (in the right/left direction in FIG. 4) becomes longer due to the employment of large-sized devices, the slide cam has been held only by the guide plates on both sides and thus remained in a deflected state. In the present invention, guide posts are provided at appropriate places so that the slide cam is not deflected.

The present invention prepares various arrangements of the guide posts, the gas springs and the wear plates according to the size of the slide cam as shown in FIGS. 5 through 10, provided that the examples of FIGS. 5 through 10 are those of a press device in which the slide cam base is arranged on the lower die, while the actuating cam is arranged on the upper die as shown in FIG. 12 described later.

Figure 5:
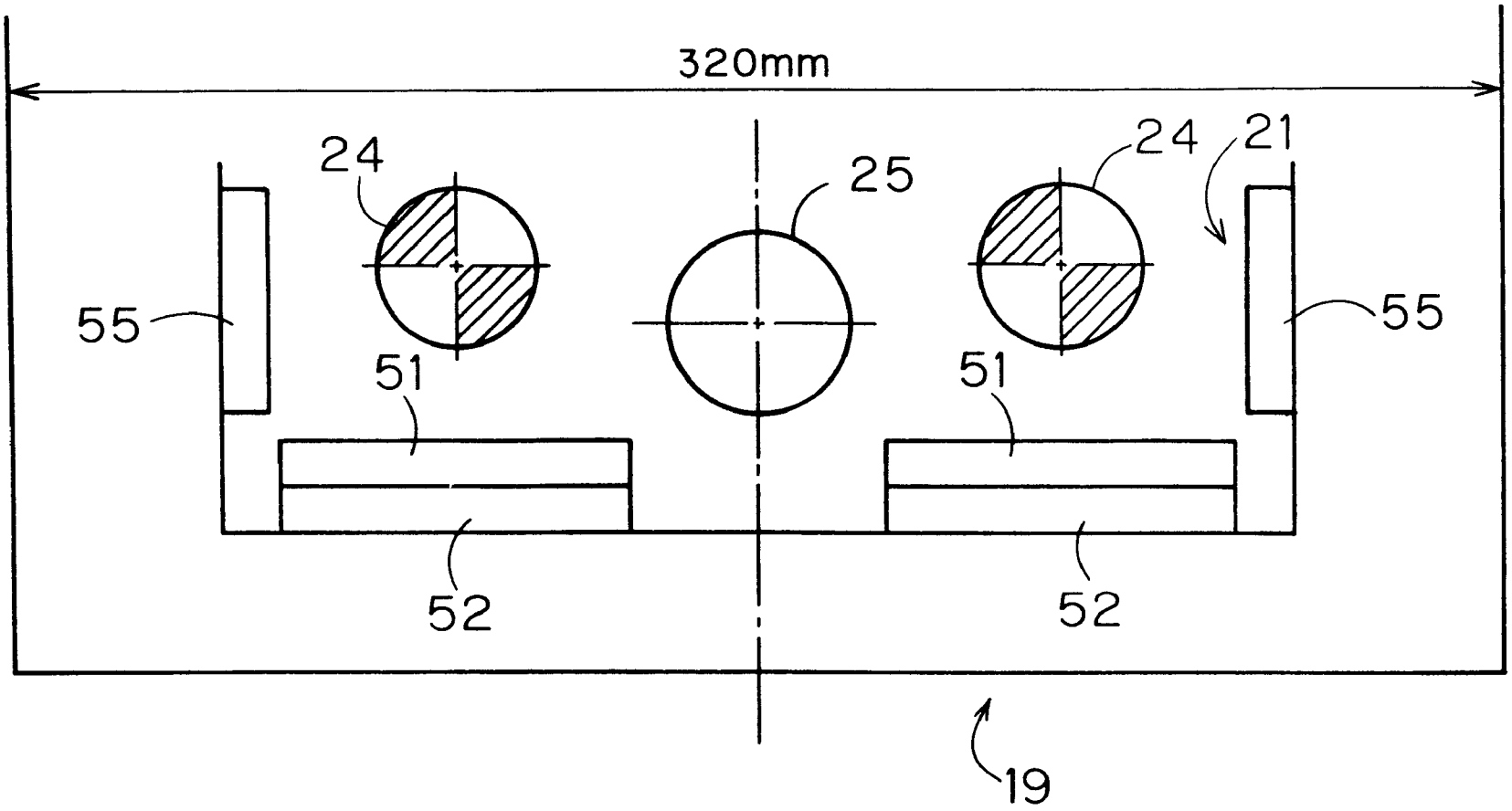
FIG. 5 is a layout view of guide posts, a gas spring and wear plates where a slide cam base is arranged on a lower die and an actuating cam on an upper die, and where the size of the slide cam is 320 mm.

In FIG. 5, where the size or the dimension in the lateral direction of the slide cam is 320 mm, the gas spring 25 is arranged at the center, arranged on both sides of the center are the guide posts 24, and the wear plates 51, 52, 55 also are arranged at respective positions as illustrated.

Figure 6:
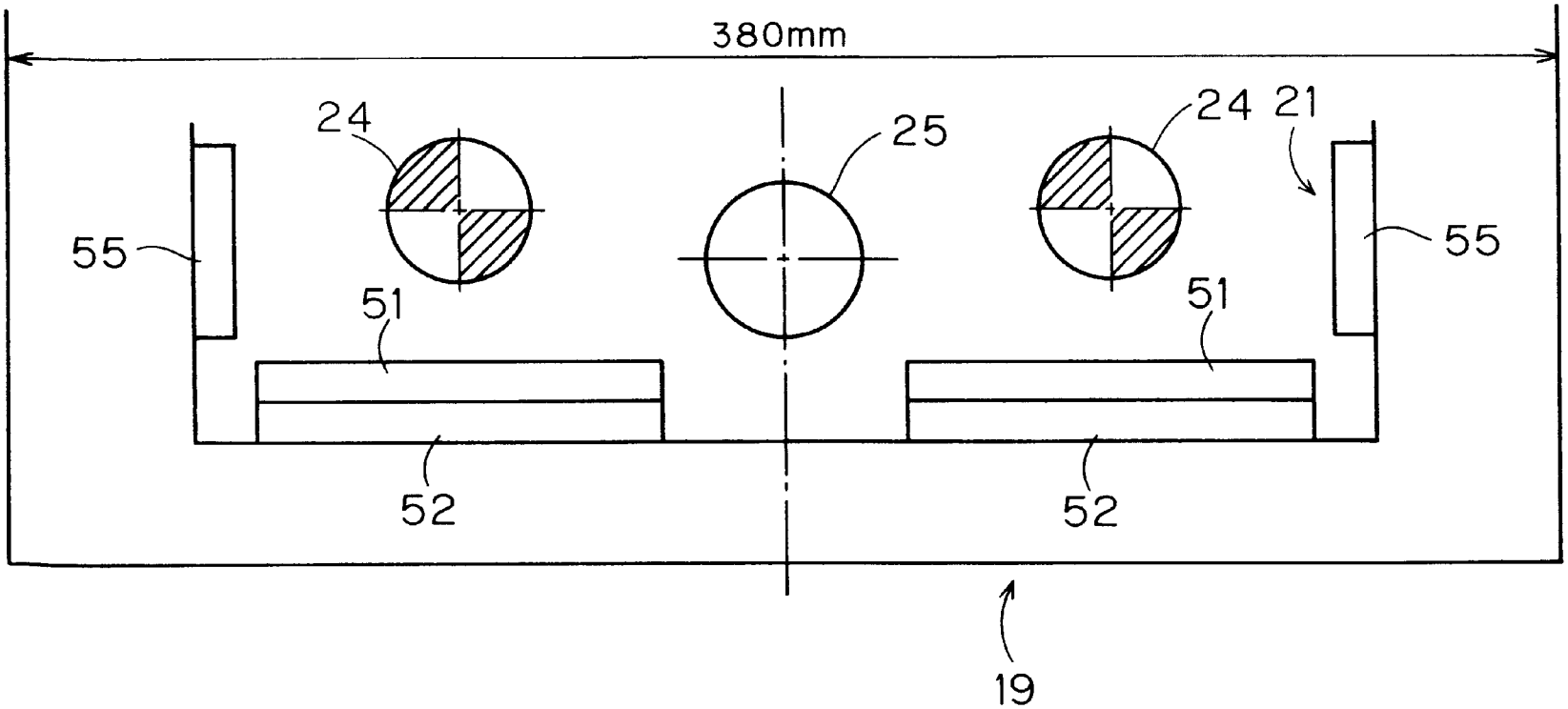
FIG. 6 is a layout view of guide posts, a gas spring and wear plates where the size of the slide cam is 380 mm.
Figure 7:
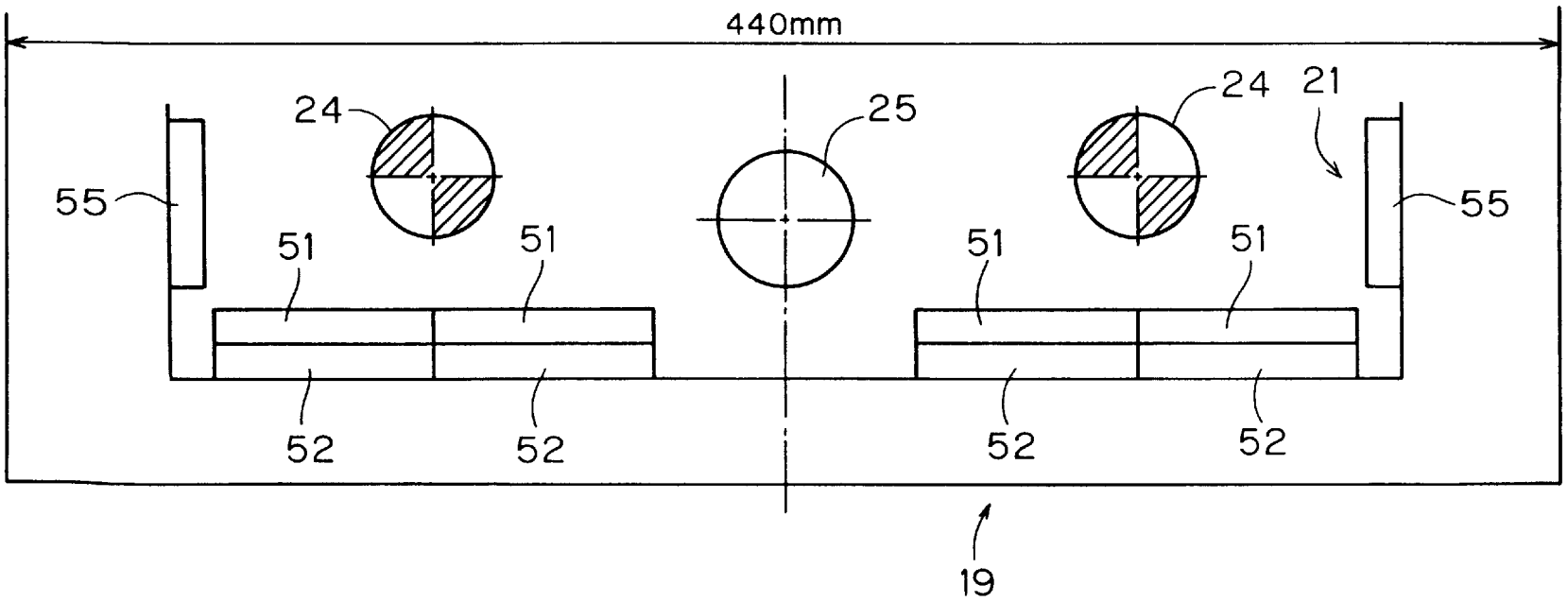
FIG. 7 is a layout view of guide posts, a gas spring and wear plates where the size of the slide cam is 440 mm.
Figure 8:
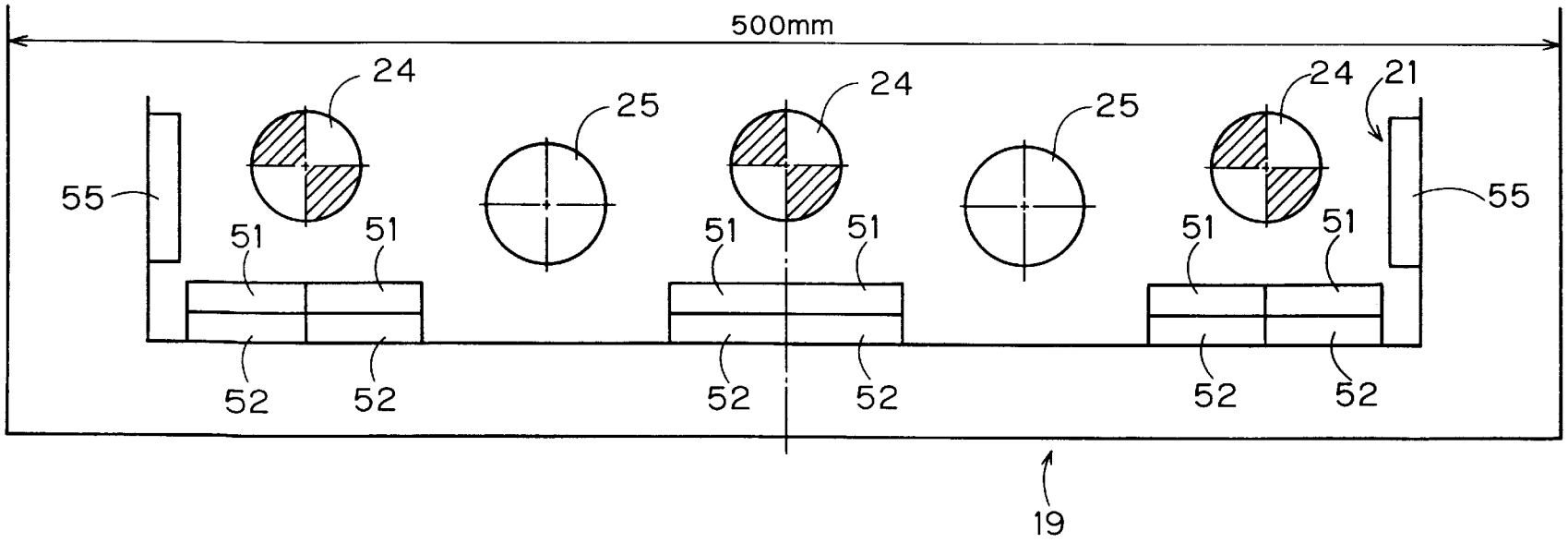
FIG. 8 is a layout view of guide posts, a gas spring and wear plates where the size of the slide cam is 500 mm.
Figure 9:
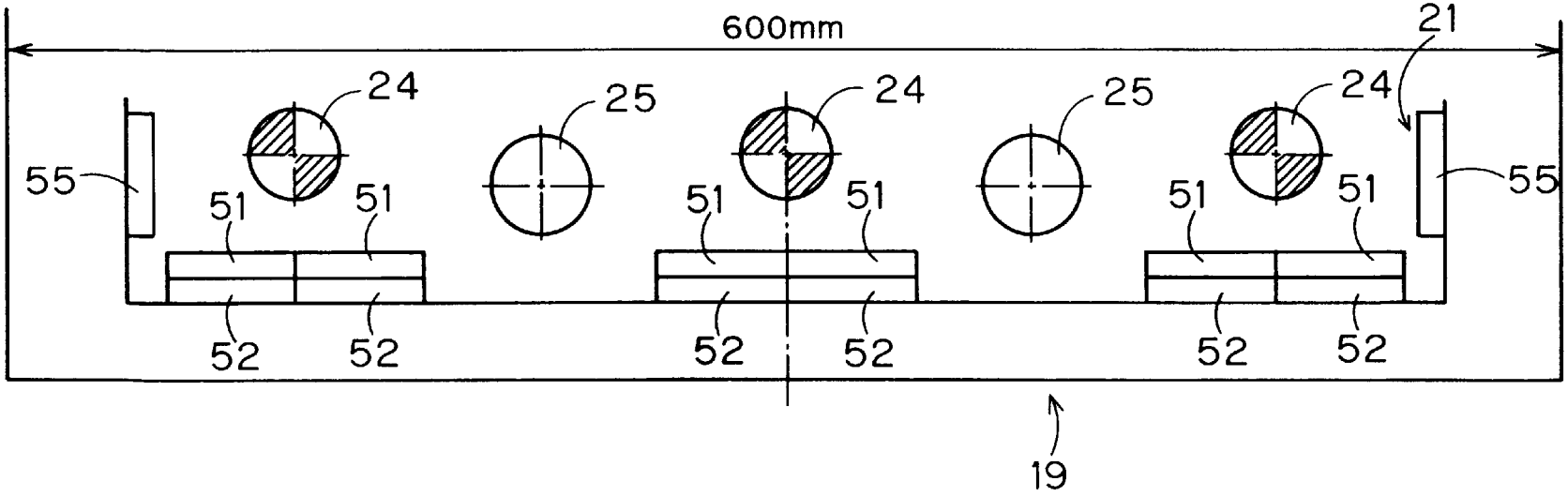
FIG. 9 is a layout view of guide posts, a gas spring and wear plates where the size of the slide cam is 600 mm.
Figure 10:
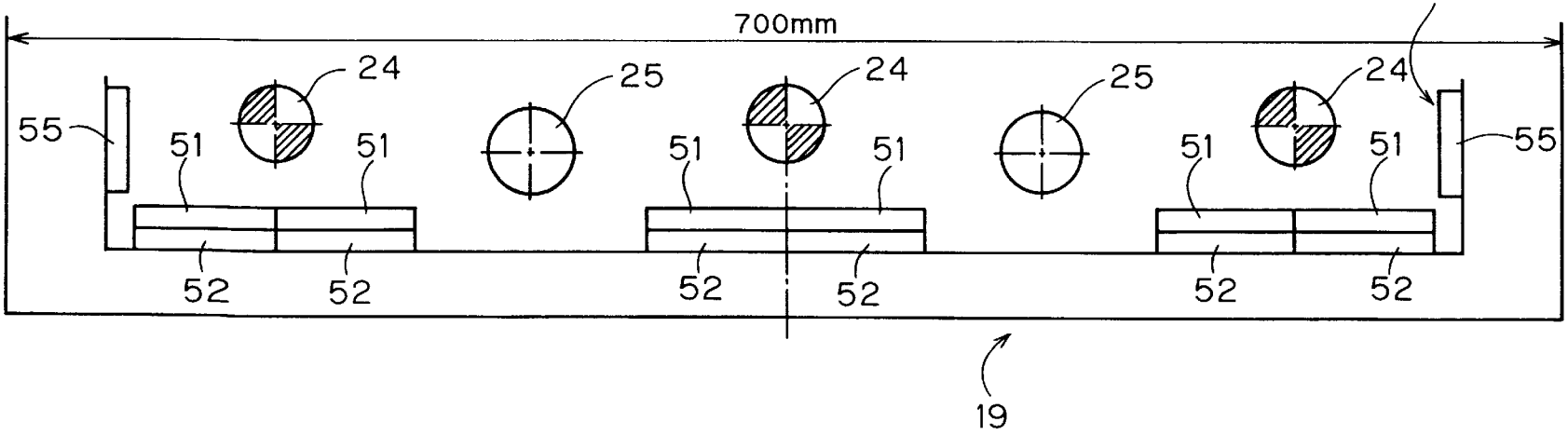
FIG. 10 is a layout view of guide posts, a gas spring and wear plates where the size of the slide cam is 700 mm.

FIG. 6 shows the arrangement of the guide posts 24 and the wear plates 51, 52, 55 where the size of the slide cam 19 is 380 mm; FIG. 7, where the size is 440 mm; FIG. 8, where the size is 500 mm; FIG. 9, where the size is 600 mm; and FIG. 10, where the size is 700 mm.

To make the movement of the slide cam 19 on the actuating cam 4 accurate, as shown in FIG. 2, the V-groove 16 of the slide cam 19 abuts against the wear plate 9 of the chevron-shaped guide member 7 to slide the slide cam 19, thereby eliminating the lateral deflection of the slide cam 19.

To forcedly move the slide cam 19 backward when the upper die 81 rises, a return plate 61 is provided. The return plate 61 is fixed with a bolt 62 to the side of the slide cam 19, and engaged with a guide member 64 fixed with a bolt 63 to the inclined face 6 of the actuating cam 4.

An embodiment of the present invention will be explained in an example of punching the work W.

As shown in FIG. 1, a spacer 71 is fixed with a bolt 72 to the front face of the slide cam 19 at a position opposite to the supporting member 2 for the work W. A punch 73 for punching the work W is held by a punch plate 74 to stand, which punch plate 74 is fixed to the spacer 71 with a bolt 75. The head of the punch 73 is internally fitted into a stripper plate 76, which stripper plate 76 is abutted by a pressurizing rubber 77. On the other hand, a die bush 78 is embedded in a position opposite to the punch 73 on the supporting member 2.

On the other hand, FIG. 11 shows a state in which the press device is at the upper dead point.

The operation of the the press device will be explained hereinafter.

As shown in FIG. 11, the work W is placed on the supporting member 2, and upper die 81 is allowed to lower. The state shown in FIG. 11 is at the upper dead point, in which the slide cam base 19 is slidably provided on the guide post 24 of the slide cam base 21 mounted to the upper base plate 22 of the upper die 81. The slide cam base 19 remains abutted against the supporting plate 29.

When the upper die 81 lowers, the wear plate 17 and the V-groove 16 of the slide cam 19 abut against the wear plate 11 and the wear plates 9 of the actuating cam 4, and the slide cam 19 moves forward and toward the work W between the actuating cam 4 and the slide cam base 21 as the upper die 81 lowers, thereby punching the work W by means of the punch 73 and the die bush 78.

FIG. 1 shows a state in which the press device when punching by the punch 71 is at the lower dead point.

Thereafter, when the upper die 81 rises, the abuting force of the gas spring 25 is transmitted from the bracket 46 to the slide cam 19 which in turn moves backward and abuts against the supporting plate 29 to stop.

Since the return plate 61 is provided on the slide cam 19, when the slide cam 19 does not move backward for some reason, the return plate 61 engages with the actuating cam 4 to cause the slide cam 19 to be forcedly moved backward.

While this embodiment describes a machining example of punching, the present invention also can be applied to other machining operations such as trimming, molding and bending.

Standardizing the size of the slide cam base 21, the slide cam 19 and the actuating cam 4 allows the press device to immediately cope with the machining of works with various sizes.

Although the above example has been explained in which the slide cam base 21 is provided on the upper die 81, while the actuating cam 4 is provided on the lower die 82, there may be provided, as shown in FIG. 12, the slide cam base 21 on the lower die 82 and the the actuating cam 4 on the upper die 81. In this example, the slide cam 19 is not suspended from the upper die 81, but provided on the lower die 82, so that such arrangement is considered safe with respect to working.

The present invention covers not only a case where the slide cam 19 is provided on the upper die 81, but also that where the slide cam 19 is arranged on the lower die 82.

The present invention, as described above, is a press device comprising a slide cam base, a slide cam guided in the slide cam base for mounting a machining member such as a punch, a biasing member provided between the slide cam base and the slide cam for biasing the slide cam, and an actuating cam for abutting to drive the slide cam, wherein the slide cam is slidably provided on a circular-section guide post installed on the slide cam base, so that there is little deflection when the slide cam base holds the slide cam to allow pressing at a high accuracy. In the present invention, the slide cam is held by the circular-section guide post, so that the time required for machining the holding portions of the slide cam can be made short, thereby providing a press device at a lower price.

The present invention is configured such that both ends of the guide post are fitted into a circular hole to support the guide post, and a slit leading to the circular hole is engraved and threadably tightened with a bolt to install the guide post, so that when the slide cam is dismounted from the slide cam base for maintenance, such dismounting is quite easy to perform.

Further, in the present invention, the biasing member employs the gas spring, so that the slide cam can positively slide on the slide cam base, thereby making the operation safe. Using a gas spring allows a long stroke to be given to the slide cam base, thereby making the machining of a large-sized work possible.

Still further, in the present invention, the wear plates are provided on respective slide faces of both the slide cam and the slide cam base, thereby satisfactorily coping with severe wear of a press device with a heavy weight.

Further, in the present invention, slide faces are provided on the side of both the slide cam and the slide cam base, thereby allowing the movement of the slide cam with respect to the slide cam base to be precisely performed.

Further, in the present invention, chevron-shaped slide faces are provided on the slide face of both the slide cam and the actuating cam, thereby eliminating a lateral deflection in the movement of the slide cam with respect to the actuating cam.

The invention being thus described, it will be obvious that the same may be varied in many ways. Such variations are not to be regarded as a departure from the spirit and scope of the invention, and all such modifications as would be obvious to one skilled in the art were intended to be included within the scope of the following claims.

What is claimed is:

1. A press device comprising:

a slide cam base including a circular-section guide post;

a slide cam slidably engaged with said circular-section guide post of the slide cam base;

a biasing member located between the slide cam base and the slide cam for biasing the slide cam; and an actuating cam for abutting with the slide cam to drive the slide cam.

2. The press device as set forth in claim 1, the guide post having opposite ends which are fitted into a circular hole to support the guide post; and a slit leading to the circular hole engraved and threadably tightened with a bolt to install the guide post.

3. The press device as set forth in claim 1, the biasing member comprising a gas spring.

4. The press device as set forth in claim 1, further comprising wear plates located on respective slide faces of both the slide cam and the slide cam base.

5. The press device as set forth in claim 1, further comprising slide faces located on the sides of both the slide cam and the slide cam base.

6. The press device as set forth in claim 1, further comprising chevron-shaped slide faces located on slide faces of both the slide cam and the actuating cam.

7. A press device comprising:

a slide cam base including a circular guide post;

an actuating cam including a guide member angularly oriented with respect to the guide post, wherein said guide post and said guide member form an acute angle;

a slide cam slidably engaged with both said guide post and said guide member; and a biasing member located between the slide cam base and the slide cam.

8. The press device according to claim 7, further comprising a machining tool mounted to said slide cam.

9. The press device according to claim 7, further comprising a circular bore in said slide cam through which the circular guide post slidably passes.

10. The press device according to claim 7, said guide member further comprising a surface mutually compatible with a lower V-shaped surface of said slide cam for slidably engaging therewith.

11. The press device according to claim 7, said biasing member comprising a gas spring.

12. The press device according to claim 7, said guide post comprising a solid circular bar.

13. The press device according to claim 7, said guide post comprising a hollow tubular bar.

14. A press device comprising:

an upper displaceable die plate and an opposing lower die plate, said upper and lower die plates being parallel to each other;

a workpiece support mounted on the lower die plate;

a slide cam base connected to the upper die plate, said slide cam base including a circular guide post angularly oriented with respect to said upper die plate;

an actuating cam connected to the lower die plate, said actuating cam including a guide member angularly oriented with respect to the lower die plate, wherein said guide post and said guide member form an acute angle having an open side of the acute angle facing said workpiece support;

a slide cam slidably engaged with both said guide post and said guide member; and a biasing member located between the slide cam base and the slide cam for biasing said slide cam away from said workpiece support;

whereby displacement of said upper die plate toward said lower die plate squeezes said slide cam toward said workpiece support.

15. The press device according to claim 14, further comprising a machining tool mounted to said slide cam engageable with a workpiece mounted on said workpiece support.

16. The press device according to claim 14, further comprising a circular bore in said slide cam through which the circular guide post slidably passes.

17. The press device according to claim 14, said guide member further comprising a surface mutually compatible with a lower V-shaped surface of said slide cam for slidably engaging therewith.

18. The press device according to claim 14, said biasing member comprising a gas spring.

19. The press device according to claim 14, said guide post comprising a solid circular bar.

20. The press device according to claim 14, said guide post comprising a hollow tubular bar.

* * * * *